US010131037B2

(12) United States Patent
Seith et al.

(10) Patent No.: US 10,131,037 B2
(45) Date of Patent: Nov. 20, 2018

(54) ANGLE IMPACT TOOL

(71) Applicant: Ingersoll-Rand Company, Davidson, NC (US)

(72) Inventors: Warren Andrew Seith, Bethlehem, PA (US); Lucas James Taylor, Easton, PA (US)

(73) Assignee: INGERSOLL-RAND COMPANY, Davidson, NC (US)

( * ) Notice: Subject to any disclaimer, the term of this patent is extended or adjusted under 35 U.S.C. 154(b) by 400 days.

(21) Appl. No.: 14/552,536

(22) Filed: Nov. 25, 2014

(65) Prior Publication Data

US 2015/0075829 A1 Mar. 19, 2015

Related U.S. Application Data

(63) Continuation of application No. 14/251,567, filed on Apr. 12, 2014, now Pat. No. 9,550,284, which is a (Continued)

(51) Int. Cl.
*B25B 21/02* (2006.01)

(52) U.S. Cl.
CPC ..... *B25B 21/02* (2013.01); *B25B 21/026* (2013.01); *B25B 21/023* (2013.01)

(58) Field of Classification Search
CPC ..... B25B 21/02; B25B 21/026; B25B 21/023; B25B 23/1405; B25B 21/00; B25B 13/481; B25B 19/00; B25F 5/02
(Continued)

(56) References Cited

U.S. PATENT DOCUMENTS 2,267,781 A 12/1941 Albertson
2,585,486 A 2/1952 Mitchell
(Continued)

FOREIGN PATENT DOCUMENTS

CN 1318451 10/2001
CN 1318451 A 10/2001
(Continued)

OTHER PUBLICATIONS

State Intellectual Property Office of the People's Republic of China, First Office Action for 201410085220.9, dated Jul. 3, 2015 (9 pages including English translation).
(Continued)

*Primary Examiner* — Michelle Lopez
(74) *Attorney, Agent, or Firm* — Jones IP Group; Wayne A. Jones

(57) ABSTRACT

An angle impact tool includes a handle assembly extending along a first axis, a prime mover in the handle, an output shaft rotatable about the first axis, and a work attachment connected to the handle assembly. An output drive is supported in the work attachment for rotation about an output axis perpendicular to the first axis. A gear assembly including a spur gear is positioned within the work attachment to transfer torque from the prime mover about the first axis to the output drive about the output axis. An impact mechanism is positioned within the work attachment and includes a hammer and an anvil. The hammer rotates under the influence of the prime mover and is operable to periodically deliver an impact load to the anvil. The output drive rotates about the output axis under the influence of the impact load being transmitted to the output drive by the anvil.

14 Claims, 11 Drawing Sheets

Related U.S. Application Data continuation of application No. 13/033,241, filed on Feb. 23, 2011, now Pat. No. 8,925,646.

(58) Field of Classification Search
USPC ..... 173/109, 216, 48, 217, 170
See application file for complete search history.

(56) References Cited

U.S. PATENT DOCUMENTS

| | | | | |
|---|---|---|---|---|
| 3,181,672 | A | | 5/1965 | Swanson |
| 3,223,182 | A | | 12/1965 | Mikiya |
| 3,270,593 | A | * | 9/1966 | Kaman ..... B25B 21/02 173/93.6 |
| 3,352,368 | A | | 11/1967 | Maffey, Jr. |
| 3,380,539 | A | | 4/1968 | Kaman |
| 3,465,646 | A | | 9/1969 | Kiester et al. |
| 3,661,217 | A | | 5/1972 | Maurer |
| 3,848,680 | A | | 11/1974 | Legler |
| 3,949,944 | A | | 4/1976 | Bent |
| 3,951,217 | A | | 4/1976 | Wallace et al. |
| 4,173,828 | A | | 11/1979 | Lustig et al. |
| D256,980 | S | | 9/1980 | Adams et al. |
| 4,222,443 | A | | 9/1980 | Chromy |
| 4,235,850 | A | | 11/1980 | Otto, Jr. |
| 4,287,795 | A | | 9/1981 | Curtiss |
| 4,355,564 | A | | 10/1982 | Gidlund |
| 4,379,492 | A | | 4/1983 | Hiraoka |
| 4,403,679 | A | | 9/1983 | Snider |
| 4,434,858 | A | | 3/1984 | Whitehouse |
| 4,488,604 | A | | 12/1984 | Whitehouse |
| 4,585,078 | A | | 4/1986 | Alexandrov et al. |
| 4,625,999 | A | | 12/1986 | Valentine et al. |
| 4,708,210 | A | | 11/1987 | Rahm |
| 4,719,976 | A | | 1/1988 | Bleicher et al. |
| 4,732,218 | A | | 3/1988 | Neumaier et al. |
| 4,735,020 | A | | 4/1988 | Schulz et al. |
| 4,740,144 | A | | 4/1988 | Biek |
| 4,776,561 | A | | 10/1988 | Braunlich et al. |
| 4,779,382 | A | | 10/1988 | Rudolf et al. |
| 4,798,249 | A | | 1/1989 | Hoereth et al. |
| 4,799,833 | A | | 1/1989 | Pennison et al. |
| 4,867,250 | A | | 9/1989 | Ono |
| 4,974,475 | A | | 12/1990 | Lord et al. |
| 5,022,469 | A | | 6/1991 | Westerberg |
| D323,961 | S | | 2/1992 | Fushiya et al. |
| D335,808 | S | | 5/1993 | Bruno et al. |
| 5,210,918 | A | | 5/1993 | Wozniak et al. |
| D339,726 | S | | 9/1993 | Bruno et al. |
| 5,293,747 | A | | 3/1994 | Geiger |
| 5,346,021 | A | | 9/1994 | Braunlich |
| 5,346,024 | A | | 9/1994 | Geiger et al. |
| D352,645 | S | | 11/1994 | Ichikawa |
| 5,443,196 | A | | 8/1995 | Burlington |
| 5,471,898 | A | | 12/1995 | Forman |
| 5,505,676 | A | | 4/1996 | Bookshar |
| D372,850 | S | | 8/1996 | Dubuque et al. |
| 5,626,198 | A | | 5/1997 | Peterson |
| D380,949 | S | | 7/1997 | Sung |
| D388,678 | S | | 1/1998 | Bantly et al. |
| D393,580 | S | | 4/1998 | Bantly et al. |
| 5,813,477 | A | | 9/1998 | Clay et al. |
| D400,771 | S | | 11/1998 | Smith et al. |
| D403,564 | S | | 1/1999 | Izumisawa |
| 5,906,244 | A | | 5/1999 | Thompson et al. |
| D414,093 | S | | 9/1999 | Zurwelle |
| 6,039,231 | A | | 3/2000 | White |
| 6,044,917 | A | | 4/2000 | Brunhoelzl |
| 6,047,779 | A | | 4/2000 | Wallace |
| 6,053,080 | A | | 4/2000 | Kaneyama et al. |
| 6,082,468 | A | | 7/2000 | Pusateri et al. |
| 6,109,366 | A | | 8/2000 | Jansson et al. |
| D434,297 | S | | 11/2000 | Iritani et al. |
| D434,958 | S | | 12/2000 | Izumisawa |
| 6,158,459 | A | | 12/2000 | Chang |
| D436,818 | S | | 1/2001 | Izumisawa |
| 6,179,063 | B1 | | 1/2001 | Borries et al. |
| D437,760 | S | | 2/2001 | Izumisawa |
| D441,628 | S | | 5/2001 | Bass et al. |
| 6,250,399 | B1 | | 6/2001 | Giardino |
| D444,363 | S | | 7/2001 | Hayakawa et al. |
| D447,029 | S | | 8/2001 | Sun et al. |
| 6,338,389 | B1 | | 1/2002 | Chang |
| D454,475 | S | | 3/2002 | Taga |
| D458,824 | S | | 6/2002 | Chen |
| D461,110 | S | | 8/2002 | Izumisawa |
| 6,460,629 | B2 | | 10/2002 | Bookshar et al. |
| 6,461,088 | B2 | | 10/2002 | Potter et al. |
| D465,982 | S | | 11/2002 | Taga |
| 6,491,111 | B1 | | 12/2002 | Livingston et al. |
| 6,502,485 | B1 | | 1/2003 | Salazar |
| 6,505,690 | B2 | | 1/2003 | Tokunaga |
| D469,673 | S | | 2/2003 | Silker et al. |
| D472,782 | S | | 4/2003 | Pusateri et al. |
| 6,561,284 | B2 | | 5/2003 | Taga |
| D476,210 | S | | 6/2003 | Chen |
| D476,870 | S | | 7/2003 | Hayakawa et al. |
| D477,512 | S | | 7/2003 | Liu et al. |
| 6,691,798 | B1 | | 2/2004 | Lindsay |
| 6,708,779 | B2 | | 3/2004 | Taga |
| 6,719,067 | B2 | | 4/2004 | Taga |
| 6,782,956 | B1 | | 8/2004 | Seith et al. |
| D496,243 | S | | 9/2004 | Huang |
| 6,789,447 | B1 | | 9/2004 | Zinck |
| 6,796,385 | B1 | | 9/2004 | Cobzaru et al. |
| D497,529 | S | | 10/2004 | Price |
| D497,785 | S | | 11/2004 | Izumisawa |
| D497,787 | S | | 11/2004 | Liao |
| D502,071 | S | | 2/2005 | Snider |
| 6,863,134 | B2 | | 3/2005 | Seith et al. |
| 6,863,135 | B2 | | 3/2005 | Kamimura et al. |
| 6,880,645 | B2 | | 4/2005 | Izumisawa |
| 6,883,619 | B1 | | 4/2005 | Huang |
| 6,889,778 | B2 | | 5/2005 | Colangelo, III et al. |
| 6,929,074 | B1 | | 8/2005 | Lai |
| 6,935,437 | B2 | | 8/2005 | Izumisawa |
| D510,513 | S | | 10/2005 | Aglassinger |
| 6,957,706 | B2 | | 10/2005 | Burger et al. |
| D511,284 | S | | 11/2005 | Henssler et al. |
| 6,968,908 | B2 | | 11/2005 | Tokunaga et al. |
| D519,807 | S | | 5/2006 | Chen |
| D521,339 | S | | 5/2006 | Chen |
| 7,036,605 | B2 | | 5/2006 | Suzuki et al. |
| 7,036,795 | B2 | | 5/2006 | Izumisawa |
| 7,040,414 | B1 | | 5/2006 | Kuo |
| D525,502 | S | | 7/2006 | Chen |
| 7,080,578 | B2 | | 7/2006 | Izumisawa |
| 7,089,833 | B2 | | 8/2006 | Hamann et al. |
| 7,109,675 | B2 | | 9/2006 | Matsunaga et al. |
| D529,353 | S | | 10/2006 | Wong et al. |
| D530,171 | S | | 10/2006 | Baker |
| 7,137,457 | B2 | | 11/2006 | Frauhammer et al. |
| 7,140,179 | B2 | | 11/2006 | Bass et al. |
| D534,047 | S | | 12/2006 | Chi |
| D535,536 | S | | 1/2007 | Ghode et al. |
| 7,174,971 | B1 | | 2/2007 | Chen |
| 7,191,849 | B2 | | 3/2007 | Chen |
| D540,134 | S | | 4/2007 | Clay |
| D540,640 | S | | 4/2007 | Clay |
| 7,311,155 | B2 | | 12/2007 | Chang |
| D569,206 | S | | 5/2008 | Takahagi et al. |
| D572,991 | S | | 7/2008 | Chen |
| D580,248 | S | | 11/2008 | Rane et al. |
| 7,461,704 | B2 | | 12/2008 | Chen |
| D587,080 | S | | 2/2009 | Rane et al. |
| 7,492,125 | B2 | | 2/2009 | Serdynski et al. |
| D590,226 | S | | 4/2009 | Chu |
| D590,680 | S | | 4/2009 | Cole et al. |
| D590,681 | S | | 4/2009 | Palermo et al. |
| D591,127 | S | | 4/2009 | Taga |
| 7,537,064 | B2 | | 5/2009 | Milbourne et al. |
| D610,888 | S | | 3/2010 | Izumisawa et al. |
| D617,620 | S | | 6/2010 | Yaschur et al. |
| 7,770,660 | B2 | | 8/2010 | Schroeder et al. |
| 7,779,931 | B2 | | 8/2010 | Townsan |

(56) References Cited

U.S. PATENT DOCUMENTS

| | | | |
|---|---|---|---|
| D624,380 | S | 9/2010 | Rane et al. |
| 7,828,072 | B2 | 11/2010 | Hashimoto et al. |
| 7,836,797 | B2 | 11/2010 | Hecht et al. |
| 7,886,840 | B2 | 2/2011 | Young et al. |
| 8,267,192 | B2 | 9/2012 | Lopano et al. |
| 8,297,373 | B2 | 10/2012 | Elger et al. |
| 8,319,379 | B2 | 11/2012 | Onose et al. |
| 8,347,979 | B2 | 1/2013 | Young et al. |
| 8,925,646 | B2 | 1/2015 | Seith et al. |
| 2002/0035890 | A1 | 3/2002 | Kusachi et al. |
| 2003/0075348 | A1 | 4/2003 | Eardley et al. |
| 2004/0014411 | A1 | 1/2004 | Jonas |
| 2004/0177978 | A1 | 9/2004 | Cobzaru et al. |
| 2004/0177980 | A1 | 9/2004 | Lucas |
| 2005/0161243 | A1 | 7/2005 | Livingston et al. |
| 2005/0279196 | A1 | 12/2005 | Hollar |
| 2005/0279519 | A1 | 12/2005 | Clark |
| 2006/0090914 | A1 | 5/2006 | Lin et al. |
| 2006/0107798 | A1 | 5/2006 | Falzone |
| 2007/0000674 | A1 | 1/2007 | Sell et al. |
| 2007/0181322 | A1 | 8/2007 | Hansson et al. |
| 2007/0028234 | A1 | 12/2007 | Yedlicka et al. |
| 2007/0282344 | A1 | 12/2007 | Yedlicka et al. |
| 2007/0289760 | A1 | 12/2007 | Sterling et al. |
| 2008/0066937 | A1 | 3/2008 | Kobayashi |
| 2008/0289843 | A1 | 11/2008 | Townsan |
| 2009/0038816 | A1 | 2/2009 | Johnson et al. |
| 2009/0272554 | A1 | 11/2009 | Young et al. |
| 2009/0272556 | A1 | 11/2009 | Young et al. |
| 2010/0107423 | A1 | 5/2010 | Bodineetal. |
| 2010/0269646 | A1* | 10/2010 | Le Du ..... B25B 13/481 81/478 |
| 2010/0276168 | A1 | 11/2010 | Murthy et al. |
| 2010/0326243 | A1 | 12/2010 | Bouchard et al. |
| 2011/0139474 | A1 | 6/2011 | Seith et al. |
| 2011/0233257 | A1 | 9/2011 | Fukinuki et al. |
| 2012/0118596 | A1 | 5/2012 | Scott |
| 2012/0138329 | A1 | 6/2012 | Sun et al. |
| 2012/0152580 | A1 | 6/2012 | Mattson et al. |
| 2012/0211249 | A1 | 8/2012 | Seith et al. |
| 2012/0326243 | A1 | 12/2012 | Huang et al. |
| 2013/0025900 | A1 | 1/2013 | Kokinelis et al. |
| 2014/0008090 | A1 | 1/2014 | Kokinelis et al. |
| 2014/0014385 | A1 | 1/2014 | Kosugi et al. |
| 2014/0216775 | A1 | 8/2014 | Seith et al. |
| 2014/0216776 | A1 | 8/2014 | Seith et al. |
| 2014/0262396 | A1 | 9/2014 | McClung |
| 2014/0274526 | A1 | 9/2014 | McClung |

FOREIGN PATENT DOCUMENTS

| | | | |
|---|---|---|---|
| CN | 1494988 | | 5/2004 |
| CN | 1550296 | A | 12/2004 |
| CN | 1704193 | A | 12/2005 |
| CN | 1903491 | A | 1/2007 |
| CN | 101351306 | A | 1/2009 |
| CN | 101657300 | A | 2/2010 |
| CN | 101856811 | | 10/2010 |
| CN | 201702726 | U | 1/2011 |
| CN | 103608149 | A | 2/2014 |
| DE | 102005001339 | A1 | 7/2006 |
| EP | 0419866 | A2 | 4/1991 |
| EP | 1138442 | A2 | 10/2001 |
| EP | 2 277 469 | | 5/2005 |
| EP | 2174754 | | 4/2010 |
| EP | 2246156 | A1 | 11/2010 |
| JP | 3248296 | | 10/1994 |
| JP | 0911140 | | 1/1997 |
| JP | 3372398 | | 1/1997 |
| JP | 07161281 | | 1/1997 |
| JP | H9-11140 | A | 1/1997 |
| JP | 2004-370306 | | 7/2006 |
| JP | 2001198853 | | 7/2011 |
| JP | 2013-000869 | | 1/2013 |
| JP | 2013 000869 | A | 1/2013 |
| WO | 99/49553 | | 9/1999 |
| WO | WO 2007/063106 | A1 | 6/2007 |
| WO | 2011/002855 | | 1/2011 |
| WO | 2011/111850 | | 9/2011 |
| WO | 2012/115921 | | 8/2012 |
| WO | WO 2012/115921 | A2 | 8/2012 |

OTHER PUBLICATIONS

State Intellectual Property Office of the People's Republic of China, First Office Action for 201410084320.X, dated Aug. 11, 2015 (12 pages including English translation).

State Intellectual Property Office of the People's Republis of China, First Office Action for 201280010271.4, dated Jan. 4, 2015 (21 pages including English translation).

State Intellectual Property Office of the People's Repeblic of China, Second Office Action for 201280010271.4, dated Aug. 20, 2015 (21 pages including English translation).

European Search Report for Application No. 12749794.9, dated Aug. 19, 2015 (10 Pages).

Ingersoll Rand Company, "2015MAX and 2025MAX Series Angle Air Impactool—Exploded View," May 2010, 2 pages.

Makita U.S.A., Inc., "18V LXT Lithium-Ion Cordless 3/8" Angle Impact Wrench, Model BTL063Z: Parts Breakdown, Jul. 2007, 1 page.

International Preliminary Examining Authority, International Preliminary Report on Patentability for PCT/US2012/25850, dated Sep. 13, 2013, 27 pages.

State Intellectual Property Office of the People's Republic of China, First Office Action for CN200810188483.7, dated Dec. 25, 2012 (10 pages including English translation).

United States Patent & Trademark Office, Office Action for U.S. Appl. No. 13/033,217, dated Jan. 4, 2013, 12 pages.

International Searching Authority, International Search Report and Written Opinion for PCT/US2012/25850, dated Dec. 26, 2012, 8 pages.

Photographs of pneumatic tools, published prior to Apr. 18, 2006, 5 pages.

Stanley Air Tools Valve, published prior to May 5, 2008, 3 pages.

Hitachi Power Tools, "Electric Tool Parts List, Cordless Angle Impact Driver, Model WH 10DCL," Aug. 29, 2008, 20 pages.

Makita Corporation, "Cordless Angle Impact Drivers, Model 6940D, 6940DW," publicly available at least as early as Sep. 28, 2010, 27 pages.

Sears Brands Management Corporation, "Operator's Manual, Craftsman Nextec, 12.0-Volt Lithium-Ion Cordless Right-Angle Impact Driver, Model No. 320.17562," 15 pages.

European Patent Application No. 15162794.0; European Search Report dated Nov. 9, 2015.

China Patent Application No. 201510173007.8; Chinese Office Action dated May 26, 2016.

China Patent Application No. 201610580589.6; Chinese Office Action dated Jun. 29, 2017.

China Patent Application No. 201510173007.8; Chinese Office Action dated Mar. 29, 2017.

European Patent Office Search Report; Application No. 17152448.1-1701; dated May 12, 2017.

English Abstract of JP 07161281.

China Office Action dated Nov. 29, 2017—CN 201510173007.8.

English Translation of China Office dated Nov. 29, 2017—CN 201510173007.8.

China Office Action dated Mar. 9, 2018—CN 201610580589.6.

English Translation of China Office dated Mar. 9, 2018—CN 201610580589.6.

* cited by examiner

ANGLE IMPACT TOOL

CROSS-REFERENCE TO RELATED APPLICATION

This application is a continuation of U.S. patent application Ser. No. 14/251,567, filed Apr. 12, 2014, now U.S. Pat. No. 9,550,284, which is a continuation of U.S. patent application Ser. No. 13/033,241, filed Feb. 23, 2011, now U.S. Pat. No. 8,925,646. The entire disclosures of the foregoing applications are incorporated by reference herein.

TECHNICAL FIELD

The present disclosure relates to angle impact tools.

SUMMARY

In one embodiment, the present disclosure relates to an angle impact tool including a handle assembly extending along a first axis and graspable by a user. A prime mover is positioned in the handle and includes an output shaft rotatable about the first axis. A work attachment is connected to the handle assembly. An output drive is supported in the work attachment for rotation about an output axis perpendicular to the first axis. A gear assembly is positioned within the work attachment. The gear assembly includes at least one spur gear and is operable to transfer torque from the prime mover about the first axis to the output drive about the output axis. An impact mechanism is positioned within the work attachment. The impact mechanism includes a hammer and an anvil. The hammer rotates under the influence of the prime mover and is operable to periodically deliver an impact load to the anvil. The output drive rotates about the output axis under the influence of the impact load being transmitted to the output drive by the anvil.

In another embodiment, the present disclosure relates to an angle impact tool including a handle assembly graspable by a user, and a prime mover at least partially contained within the handle assembly. The prime mover has a rotor rotatable about a first axis. An output drive is functionally coupled to the prime mover and selectively rotated in response to rotation of the rotor. The output drive defines an output axis about which the output drive rotates. The output axis is substantially perpendicular to the first axis. At least one bevel gear is functionally positioned between the rotor and the output drive. The at least one bevel gear is rotatable in response to rotation of the rotor. At least one spur gear is functionally positioned between the rotor and the output drive. The at least one spur gear is rotatable in response to rotation of the rotor. An impact mechanism is functionally positioned between the prime mover and the output drive. The impact mechanism selectively drives the output drive with impact forces in response to rotation of the rotor.

In yet another embodiment, the present disclosure relates to an angle impact tool including a handle assembly extending generally along a first axis and graspable by a user, a prime mover having an output shaft rotatable about the first axis, and an output drive functionally coupled to the prime mover and selectively rotated in response to rotation of the output shaft. The output drive defines an output axis about which the output drive rotates. The output axis is substantially perpendicular to the first axis. A first spur gear is functionally positioned between the prime mover and the impact mechanism. The first spur gear is rotatable in response to rotation of the output shaft. A second spur gear meshes with the first spur gear for rotation in response to rotation of the first spur gear. A third spur gear meshes with the second spur gear for rotation in response to rotation of the first and second spur gears. A first bevel gear is connected to the output shaft for rotation with the output shaft about the first axis. A second bevel gear is functionally positioned between the first bevel gear and the first spur gear, such that rotation of the first bevel gear about the first axis causes rotation of the second bevel gear to rotate about a second axis and the first spur gear to rotate about a third axis. The second axis and the third axis are substantially perpendicular to the first axis. An impact mechanism is functionally positioned between the prime mover and the output drive. The impact mechanism selectively drives the output drive in response to rotation of the output shaft. The impact mechanism includes a hammer functionally coupled to the output shaft for rotation with the output shaft, and an anvil functionally coupled to the output drive. The hammer is operable to impact the anvil to drive the output drive with impact forces in response to rotation of the output shaft.

Other aspects of the present disclosure will become apparent by consideration of the detailed description and accompanying drawings.

DETAILED DESCRIPTION

Before any of the embodiments of the present disclosure are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
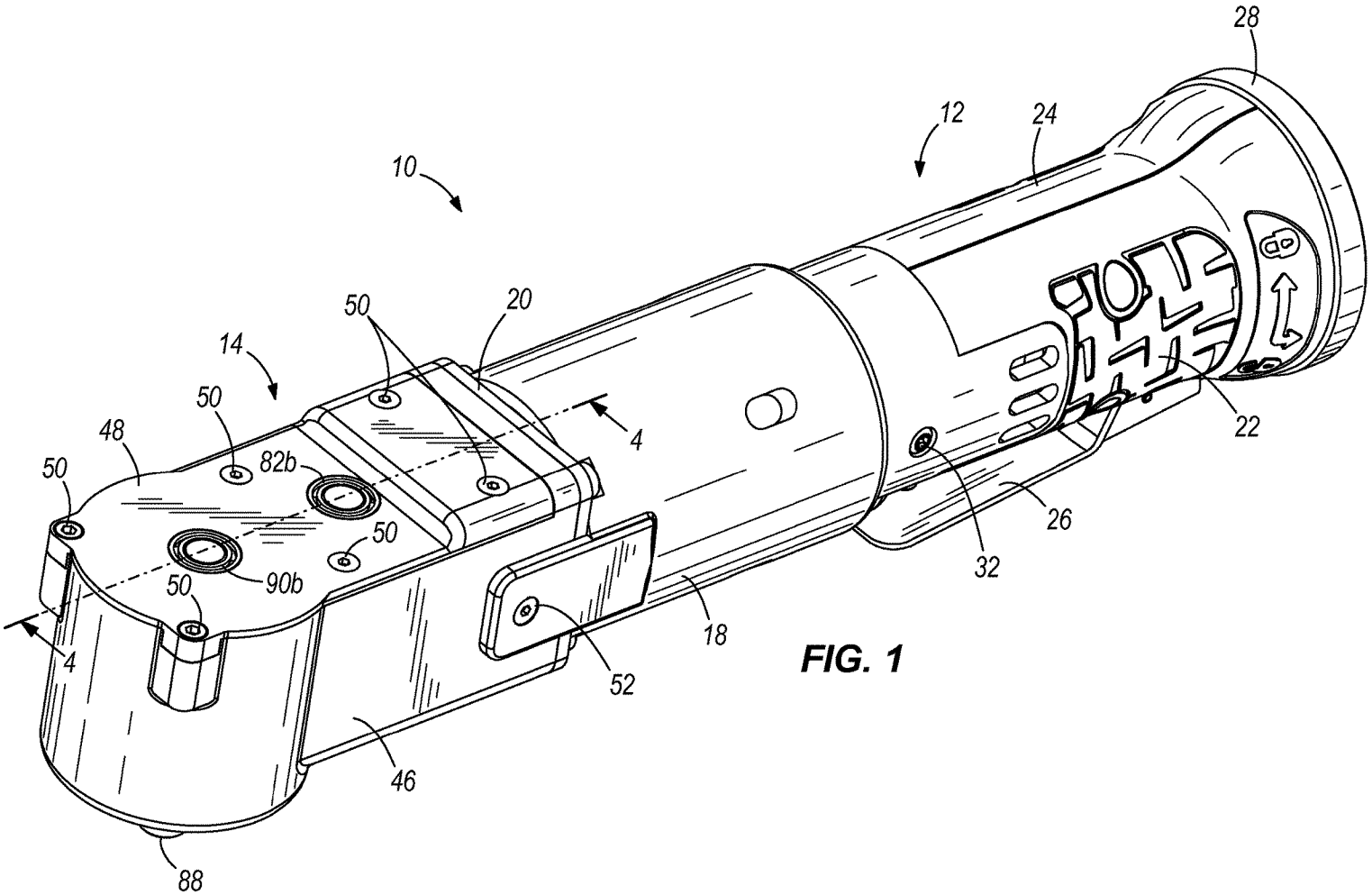
FIG. 1 is a perspective view of an angle impact tool.
Figure 2:
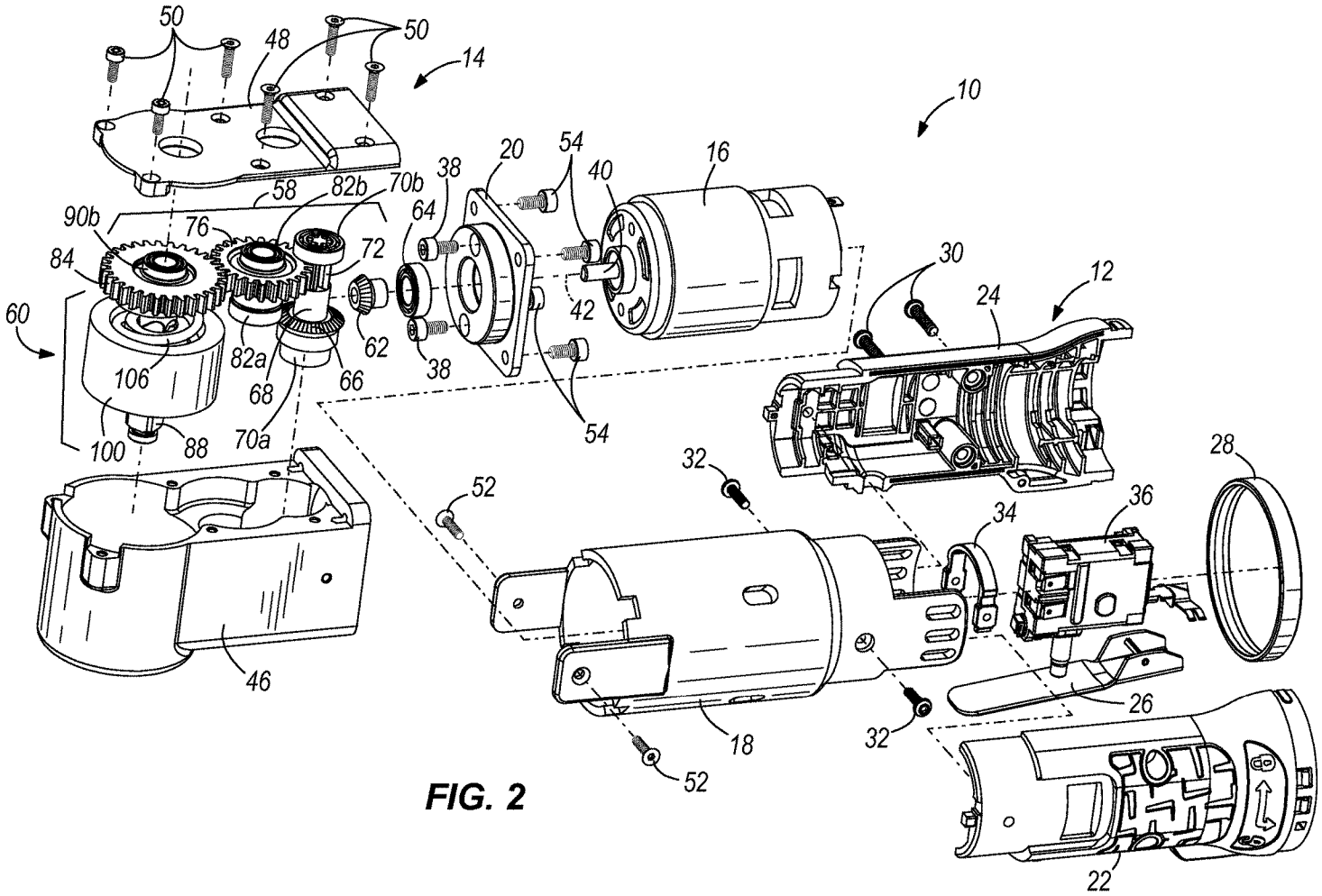
FIG. 2 is an exploded view of the tool of FIG. 1.

FIGS. 1 and 2 illustrate an angle impact tool 10 that includes a handle or motor assembly 12 and a work attachment 14. The illustrated motor assembly 12 includes a motor 16, a motor housing 18, a motor bracket 20, a first grip portion 22, a second grip portion 24, a trigger lever 26, and a lock ring 28. The lock ring 28 and a plurality of fasteners 30 retain the first and second grip portions 22 and 24 together. The motor housing 18 is coupled to the first and second grip portions 22 and 24 by a plurality of fasteners 32 and a U-shaped part 34. A switch 36 is included in the motor assembly 12 between the first and second grip portions 22 and 24. The switch 36 is coupled (mechanically and/or electrically) to the trigger lever 26, such that actuation of the trigger lever 26 causes actuation of the switch 36 and, therefore, operation of the motor 16.

The motor bracket 20 is coupled to the motor 16 by a plurality of fasteners 38. The motor 16 includes an output shaft, such as the illustrated rotor 40, that is rotatable about a longitudinal handle axis 42. The illustrated motor 16 is an electric motor, but any suitable prime mover, such as the pneumatic motor disclosed in U.S. Pat. No. 7,886,840, which is herein incorporated by reference, can be utilized. Although not specifically illustrated, a battery and a directional reverse switch are provided on the angle impact tool 10.

The illustrated work attachment 14 includes an angle housing 46 and an angle housing plate 48. A plurality of fasteners 50 couple the angle housing plate 48 to the angle housing 46. The motor housing 18 is coupled to the angle housing 46 with a plurality of fasteners 52. The motor bracket 20 is coupled to the angle housing 46 by a plurality of fasteners 54.

Figure 4:
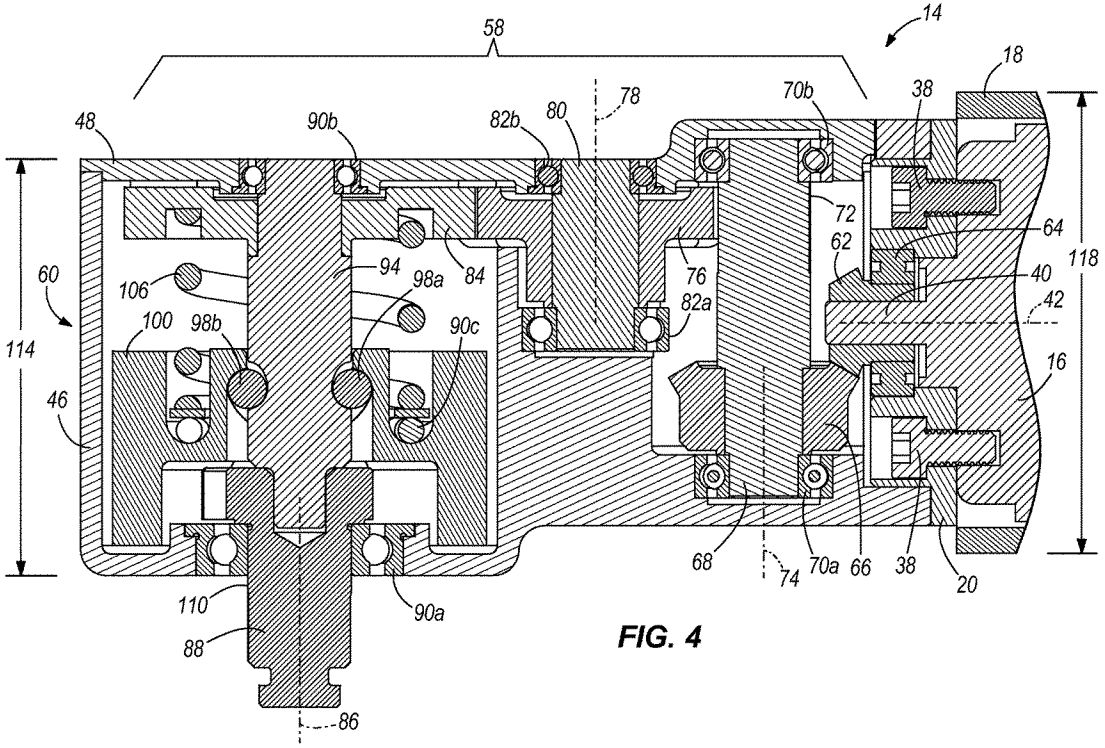
FIG. 4 is a cross-sectional view taken along line 4-4 of FIG. 1.
Figure 5A:
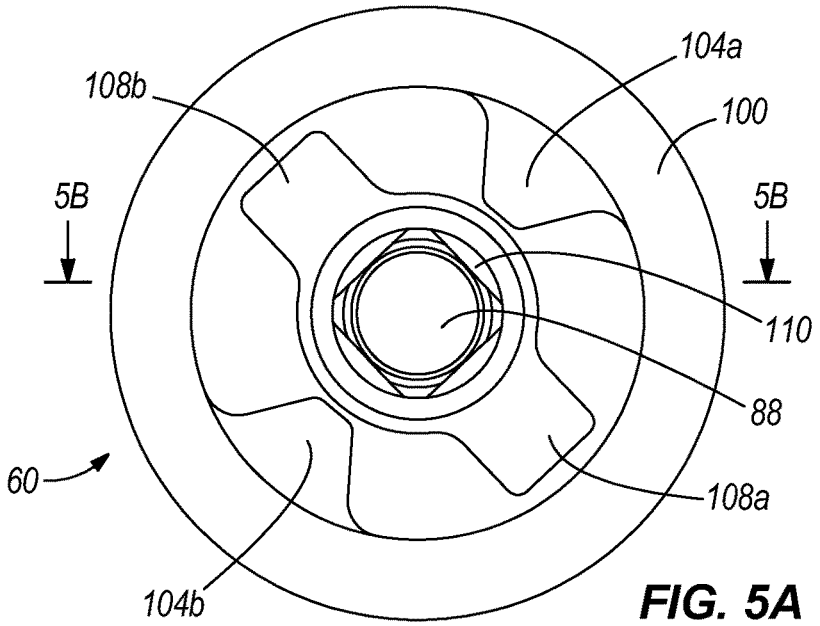
FIGS. 5A-5J illustrate an impact cycle of the impact tool of FIGS. 1-4.
Figure 5B:
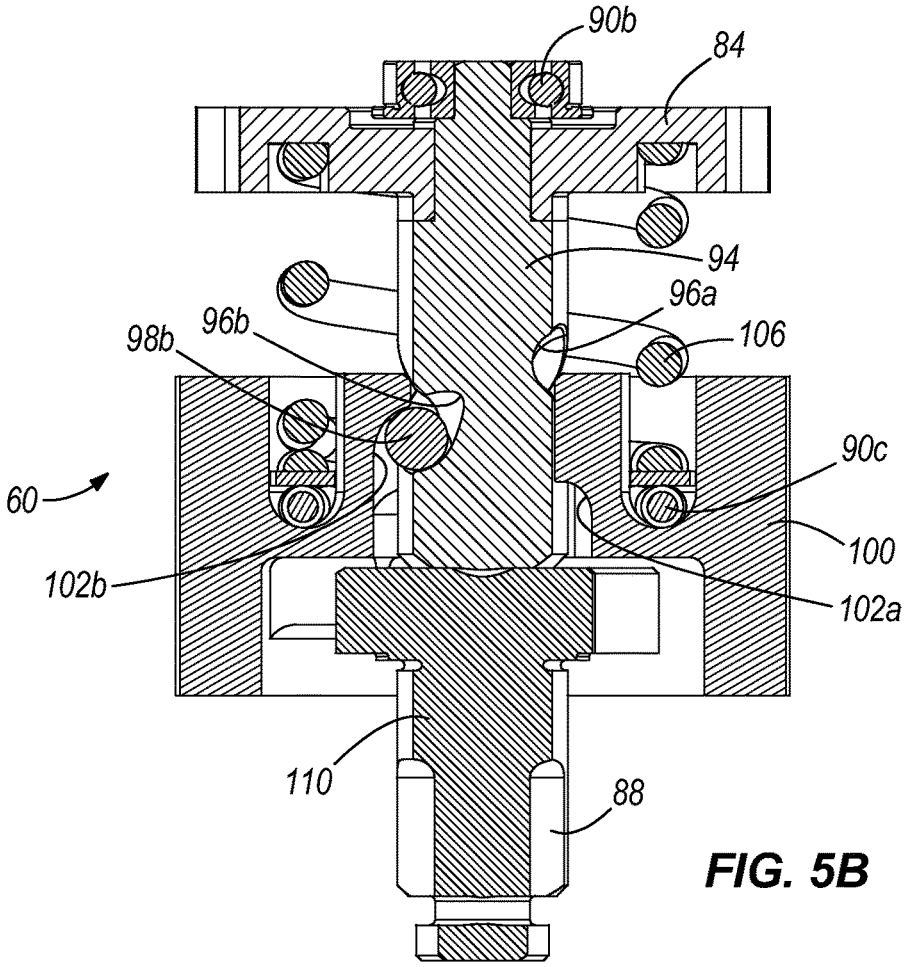
Figure 5C:
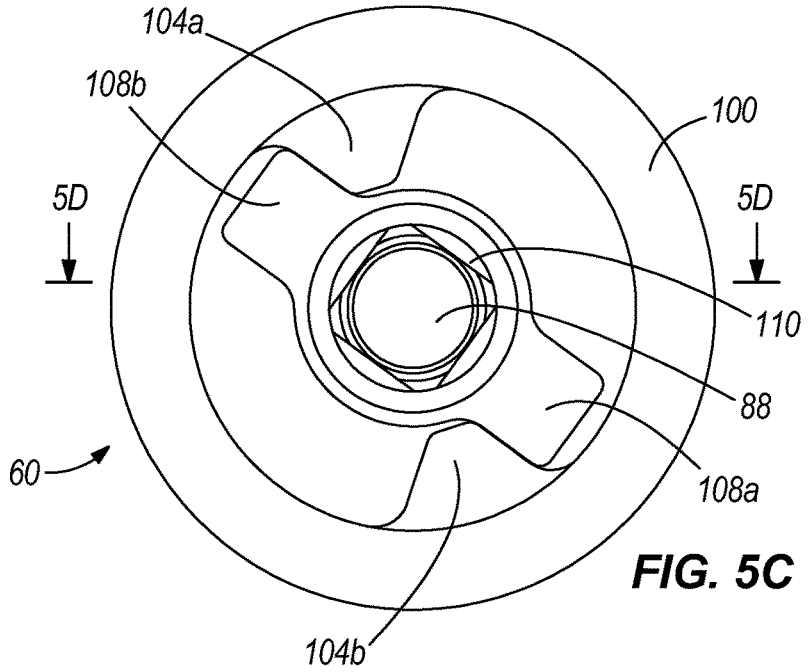
Figure 5D:
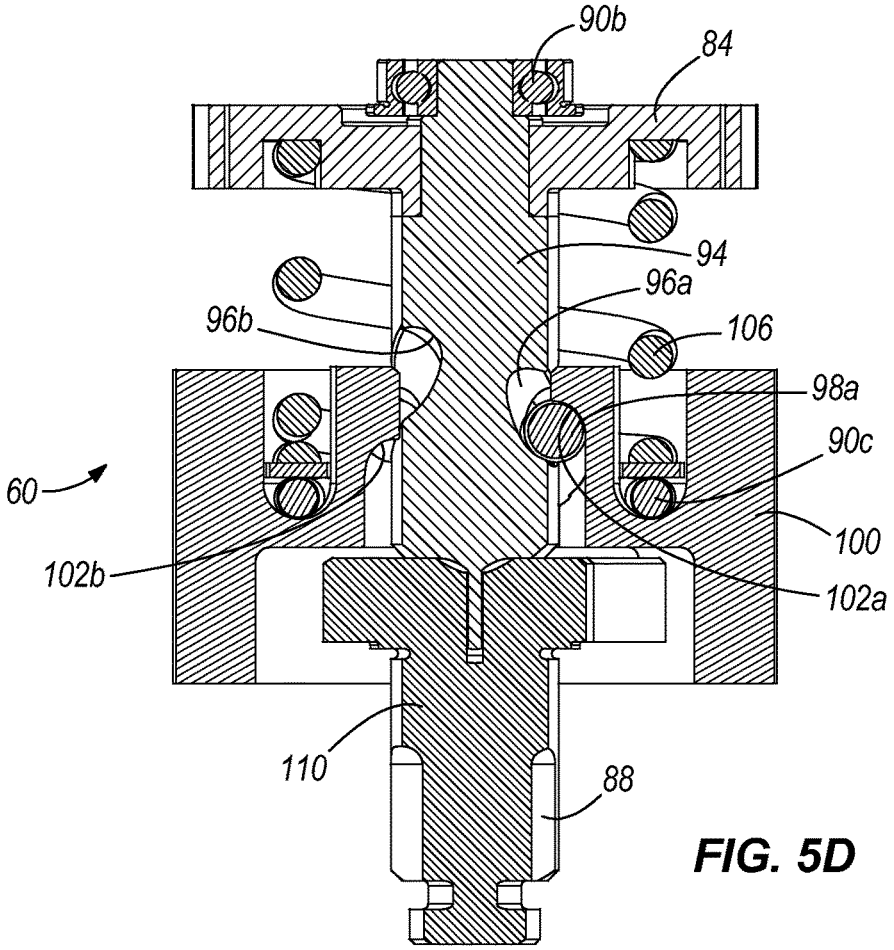
Figure 5E:
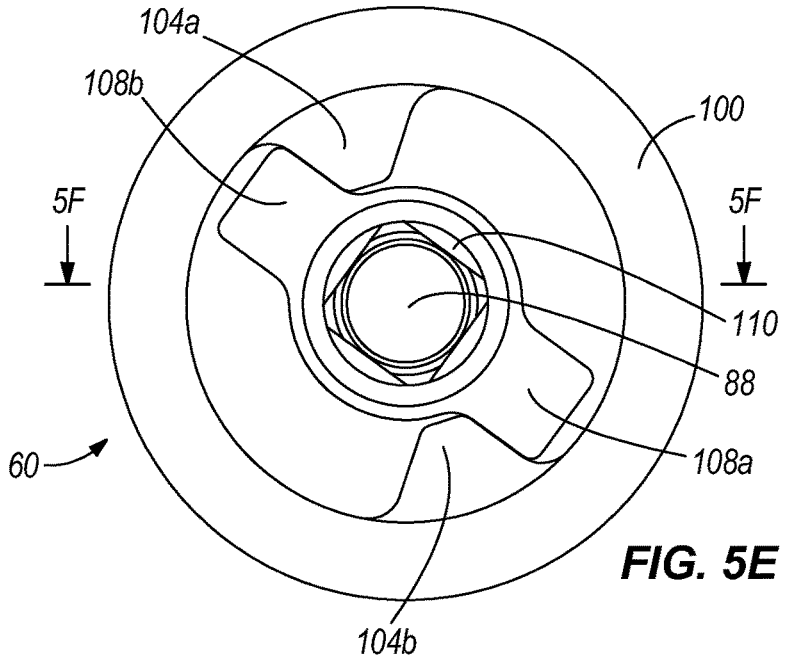
Figure 5F:
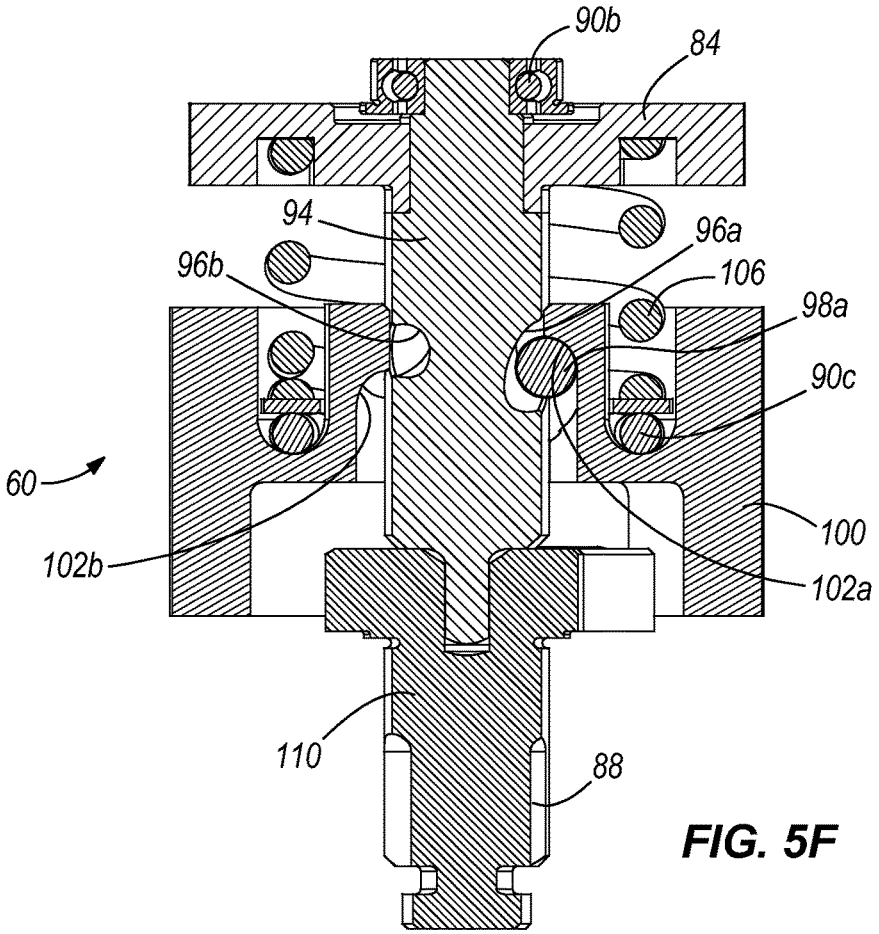
Figure 5G:
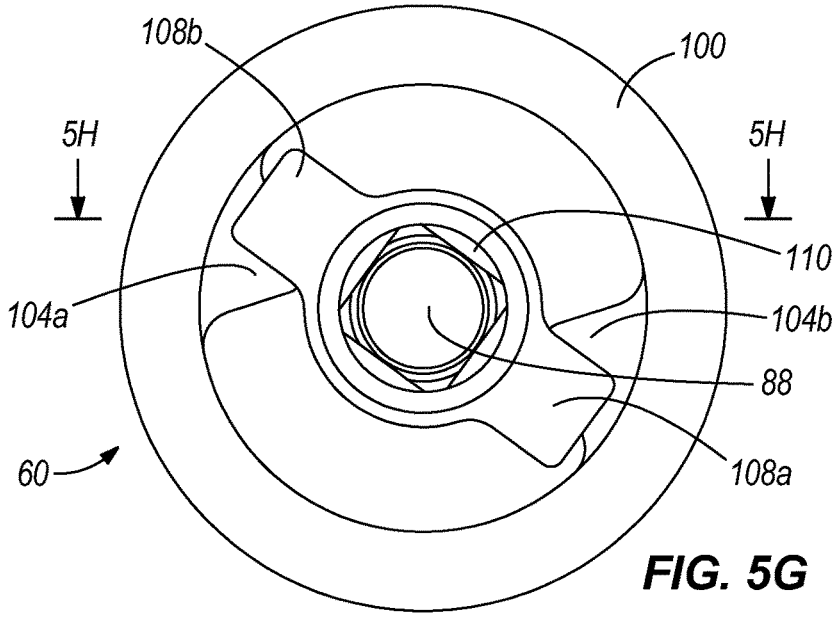
Figure 5H:
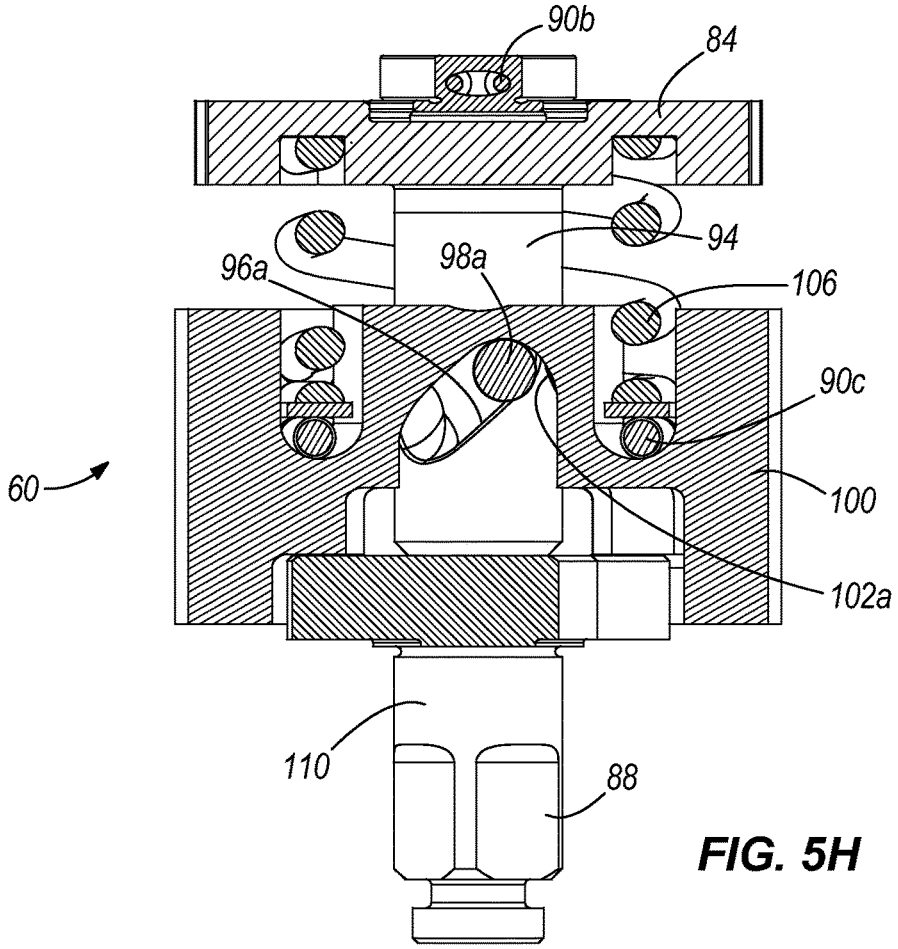
Figure 5I:
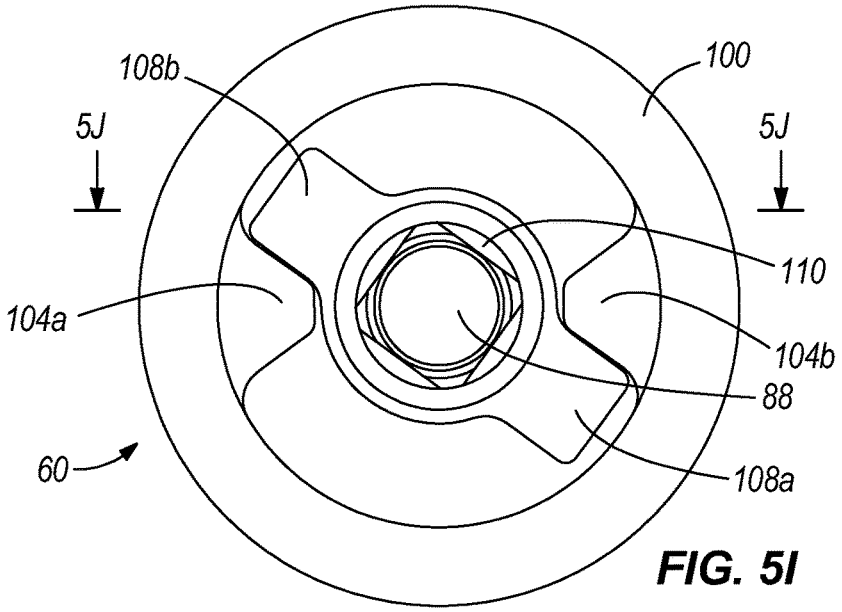
Figure 5J:
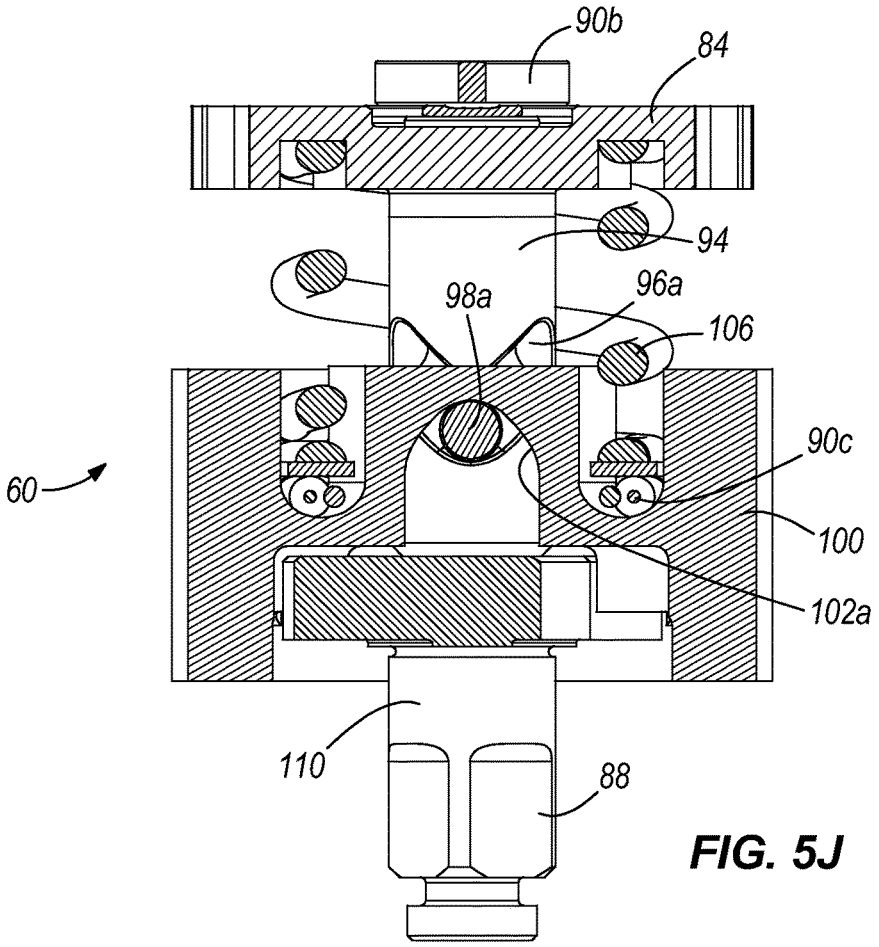

The illustrated work attachment 14 houses a gear assembly 58 and an impact mechanism 60. The gear assembly 58 includes a first bevel gear 62 coupled to the rotor 40 for rotation with the rotor 40 about the longitudinal handle axis 42. A first bearing 64 is positioned between the first bevel gear 62 and the motor bracket 20. The illustrated gear assembly 58 includes a second bevel gear 66 that meshingly engages the first bevel gear 62. The second bevel gear 66 is coupled to a shaft 68 for rotation with the shaft 68. The shaft 68 is supported in the work attachment 14 by bearings 70*a* and 70*b*. The shaft 68 includes a splined portion 72 near bearing 70*b*. The shaft 68 rotates about an axis 74 (FIG. 4). The splined portion 72 functions as a spur gear and, in some embodiments, can be replaced with a spur gear.

The splined portion 72 engages a gear, such as a first spur gear 76, such that rotation of the splined portion 72 causes rotation of the first spur gear 76 about an axis 78 (FIG. 4). The first spur gear 76 is coupled to a second shaft 80 for rotation with the second shaft 80 (FIG. 4) about the axis 78. The second shaft 80 is supported for rotation with respect to the work attachment 14 by bearings 82*a*, 82*b*.

The first spur gear 76 meshes with a second spur gear 84 to cause rotation of the second spur gear 84 about an axis 86 (FIG. 4). The second spur gear 84 is coupled to a square drive 88 through the impact mechanism 60 for selectively rotating the square drive 88. The second spur gear 84 and the square drive 88 are supported for rotation within the angle housing 46 by bearings 90*a*, 90*b*, 90*c* (FIG. 4). The axes 74, 78, and 86 are all substantially parallel to each other and are thus each substantially perpendicular to axis 42.

The square drive 88 is connectable to a socket or other fastener-driving output element. In some constructions, the work attachment 14 can be substantially any tool adapted to be driven by a rotating output shaft of the motor 16, including but not limited to an impact wrench, gear reducer, and the like.

Figure 3:
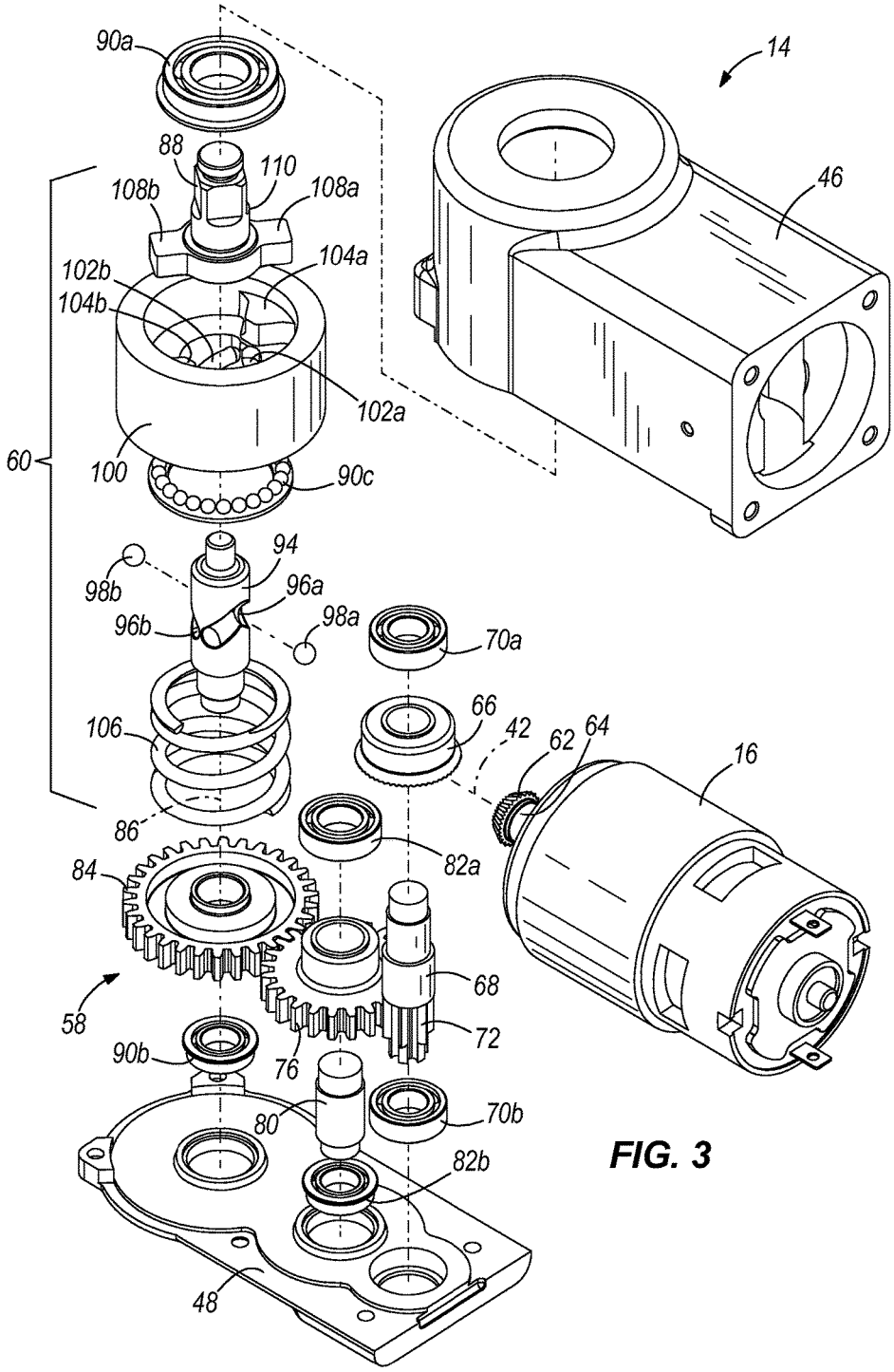
FIG. 3 is an exploded view of an angle head of the tool of FIG. 1.

With reference to FIGS. 2-4, the impact mechanism 60 can be a standard impact mechanism, such as a Potts mechanism or a Maurer mechanism. The illustrated impact mechanism 60 includes a cam shaft 94 coupled to the second spur gear 84 for rotation with the second spur gear 84 about the second axis 86. The illustrated cam shaft 94 includes opposite cam grooves 96*a*, 96*b* that define pathways for respective balls 98*a*, 98*b*. The illustrated impact mechanism 60 further includes a hammer 100 that includes opposite cam grooves 102*a*, 102*b* that are substantially mirror-images of cam grooves 96*a*, 96*b*. The balls 98*a*, 98*b* are retained between the respective cam grooves 96*a*, 96*b*, 102*a*, 102*b*. The hammer 100 also includes first and second opposite jaws 104*a*, 104*b*.

The first bevel gear 62 actuates the gear assembly 58 and the impact mechanism 60 to functionally drive an output, such as the square drive 88, as shown in the illustrated embodiment. The square drive 88 is rotated about the axis 86 which is non-parallel to the axis 42. In the illustrated embodiment, the axis 86 is perpendicular to the axis 42. In other embodiments (not shown), the axis 86 is at an acute or obtuse non-parallel angle to the axis 42.

A biasing member, such as an axial compression spring 106 is positioned between the second spur gear 84 and the hammer 100 to bias the hammer 100 away from the second spur gear 84. In the illustrated embodiment, the spring 106 rotates with the second spur gear 84 and the bearing 90*c* permits the hammer 100 to rotate with respect to the spring 106. Other configurations are possible, and the illustrated configuration is given by way of example only.

The illustrated square drive 88 is formed as a single unitary, monolithic piece with first and second jaws 108*a*, 108*b* to create an anvil 110. The anvil 110 is supported for rotation within the angle housing 46 by the bearing 90*a*. The jaws 104*a*, 104*b* impact respective jaws 108*a*, 108*b* to functionally drive the square drive 88 in response to rotation of the second spur gear 84. The term "functionally drive" is herein defined as a relationship in which the jaws 104*a*, 104*b* rotate to impact the respective jaws 108*a*, 108*b* and, thereby, cause intermittent rotation of the square drive 88, in response to the impact of jaws 104*a*, 104*b* on the respective jaws 108*a*, 108*b*. The jaws 104*a*, 104*b* intermittently impact the jaws 108*a*, 108*b*, and therefore the jaws 104*a*, 104*b* functionally drive rotation of the square drive 88. Further, any element that directly or indirectly drives rotation of the hammer to impact the anvil may be said to "functionally drive" any element that is rotated by the anvil as a result of such impact.

The impact cycle is repeated twice every rotation and is illustrated in FIGS. 5A-5J in which the jaws 104*a*, 104*b* impact the jaws 108*a*, 108*b*. The spring 106 permits the hammer 100 to rebound after impact, and balls 98*a*, 98*b* guide the hammer 100 to ride up around the cam shaft 94, such that jaws 104*a*, 104*b* are spaced axially from jaws 108*a*, 108*b*. The jaws 104*a*, 104*b* are permitted to rotate past the jaws 108*a*, 108*b* after the rebound. FIGS. 5A-5J illustrate an impact cycle of the impact tool of FIGS. 1-4. Two such impact cycles occur per rotation of the hammer 100.

A head height dimension 114 of the work attachment 14 is illustrated in FIG. 4. The head height dimension 114 is the axial distance from the top of the angle housing plate 48 to the bottom of the angle housing 46. The head height dimension 114 is reduced so that the work attachment 14 can fit into small spaces. The motor housing 18 defines a motor housing height dimension 118, as shown in FIG. 4. The head height dimension 114 is smaller than or substantially equal to the motor housing height dimension 118. Such a configuration permits insertion of the tool 10 into smaller spaces than has previously been achievable without compromising torque. In one embodiment, the head height dimension 114 is less than two inches, and the angle impact tool 10 has a maximum torque of about 180 foot-pounds and a rate of rotation of about 7,100 rotations-per-minute.

Figure 6:
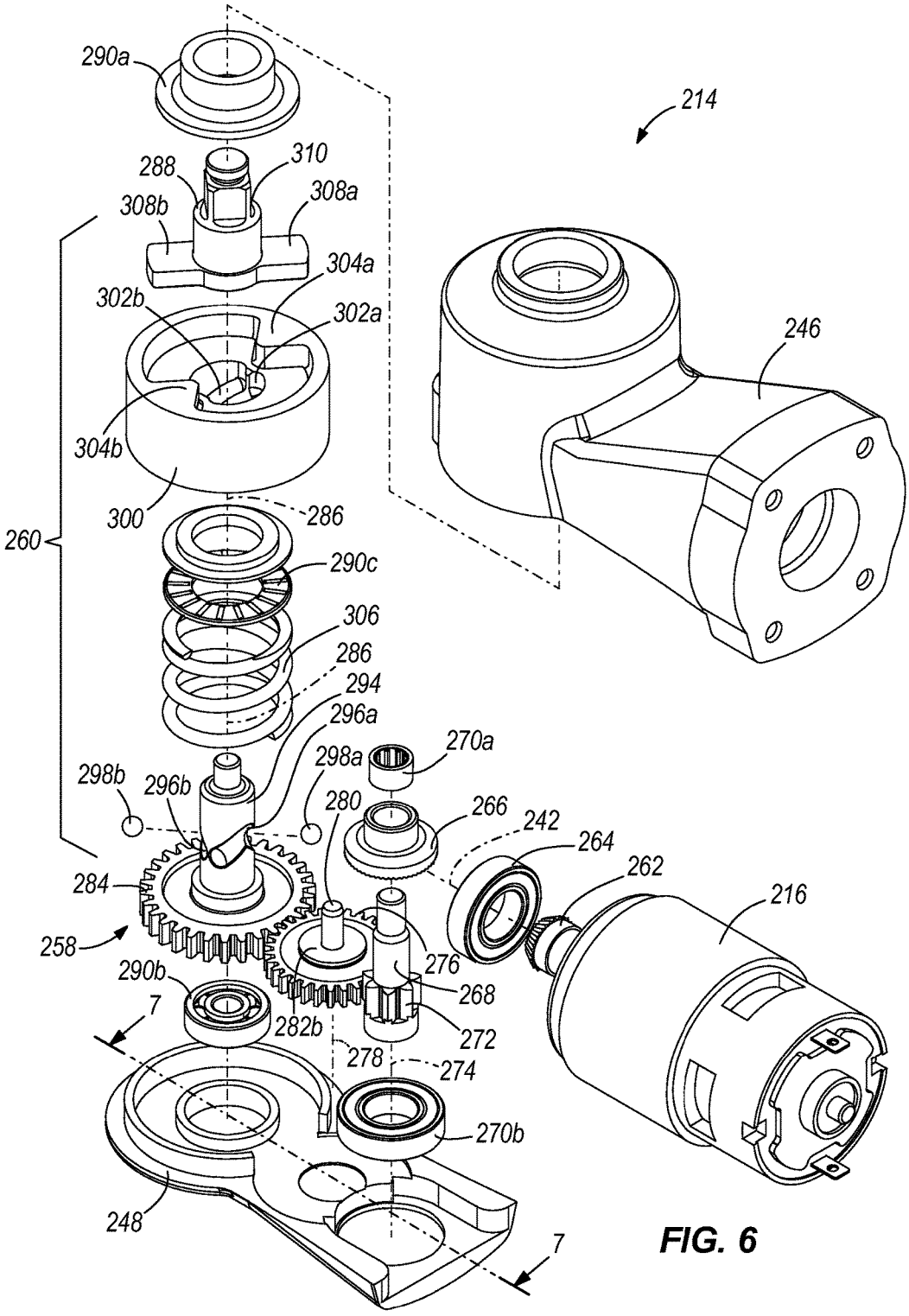
FIG. 6 is an exploded view of another alternate embodiment of an angle head of an impact tool.
Figure 7:
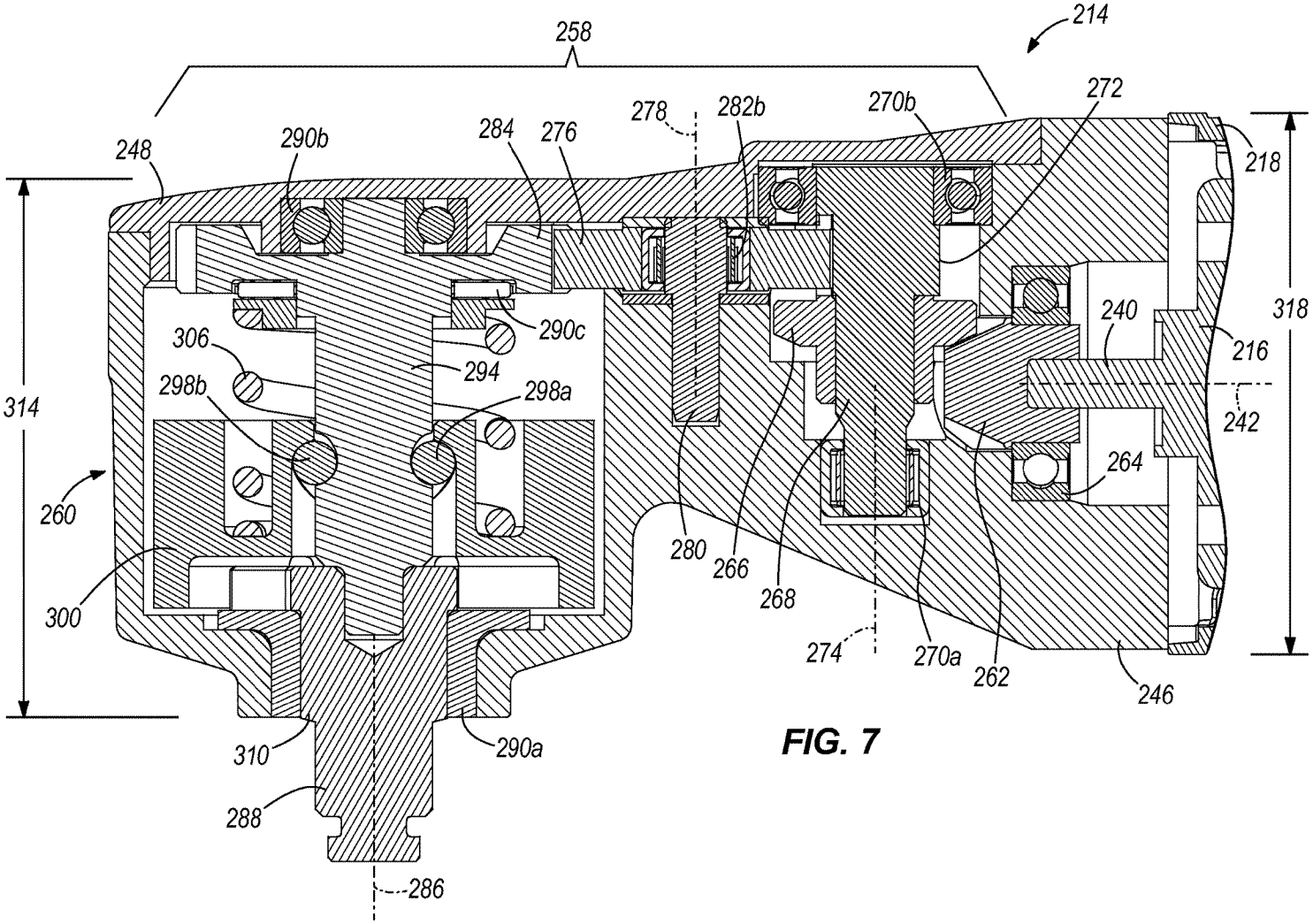
FIG. 7 is a cross-sectional view taken along line 7-7 of FIG. 6.

FIGS. 6 and 7 illustrate an alternate embodiment of an angle head work attachment 214 for an angle impact tool. The angle head work attachment 214 is coupled to a handle and motor 216 having a rotor 240. The motor 216 is supported by a motor housing 218. The illustrated motor 216 is an electric motor, but any suitable prime mover, such as the pneumatic motor disclosed in U.S. Pat. No. 7,886,840, which is herein incorporated by reference, can be utilized. Although not specifically illustrated, a battery and a directional reverse switch are provided on the angle impact tool.

The angle head work attachment 214 includes an angle housing 246 and an angle housing plate 248 that support a gear assembly 258 and an impact mechanism 260. The rotor 240 rotates about a longitudinal handle axis 242. A first bevel gear 262 is coupled to the rotor 240 for rotation with the rotor 240 about the longitudinal handle axis 242. A first bearing 264 is positioned between the first bevel gear 262 and the motor housing 218. The illustrated gear assembly 258 includes a second bevel gear 266 that meshingly engages the first bevel gear 262. The second bevel gear 266 is coupled to a shaft 268 for rotation with the shaft 268. The shaft 268 is supported in the work attachment 214 by bearings 270*a* and 270*b*. The shaft 268 includes a splined portion 272 near bearing 270*b*. The shaft 268 rotates about an axis 274. The splined portion 272 functions as a spur gear and, in some embodiments, can be replaced with a spur gear.

The splined portion 272 engages a gear, such as a first spur gear 276, such that rotation of the splined portion 272 causes rotation of the first spur gear 276 about an axis 278. The first spur gear 276 is coupled to a second shaft 280 for rotation with the second shaft 280 about the axis 278. The second shaft 280 is supported for rotation with respect to the work attachment 214 by bearings 282*a*, 282*b*.

The first spur gear 276 meshes with a second spur gear 284 to cause rotation of the second spur gear 284 about an axis 286. The second spur gear 284 is coupled to a square drive 288 through the impact mechanism 260 for selectively rotating the square drive 288. The second spur gear 284 and the square drive 288 are supported for rotation with respect to the work attachment 214 by bushing 290*a* and bearings 290*b*, 290*c*. The axes 274, 278 and 286 are all substantially parallel to each other and are thus each substantially perpendicular to axis 242.

The square drive 288 is connectable to a socket or other fastener-driving output element. In some constructions, the work attachment 214 can be substantially any tool adapted to be driven by a rotating output shaft of the motor 216, including but not limited to an impact wrench, gear reducer, and the like.

The impact mechanism 260 can be a standard impact mechanism, such as a Potts mechanism or a Maurer mechanism. The illustrated impact mechanism 260 includes a cam shaft 294 coupled to the second spur gear 284 for rotation with the second spur gear 284 about the second axis 286. The illustrated cam shaft 294 includes opposite cam grooves 296*a*, 296*b* that define pathways for respective balls 298*a*, 298*b*. The illustrated impact mechanism 260 further includes a hammer 300 that includes opposite cam grooves 302*a*, 302*b* that are substantially mirror-images of cam grooves 296*a*, 296*b*. The balls 298*a*, 298*b* are retained between the respective cam grooves 296*a*, 296*b*, 302*a*, 302*b*. The hammer 300 also includes first and second opposite jaws 304*a*, 304*b*.

The first bevel gear 262 actuates the gear assembly 258 and the impact mechanism 260 to functionally drive an output, such as the square drive 288, as shown in the illustrated embodiment. The square drive 288 is rotated about the axis 286 which is non-parallel to the axis 242. In the illustrated embodiment, the axis 286 is perpendicular to the axis 242. In other embodiments (not shown), the axis 286 is at an acute or obtuse non-parallel angle to the axis 242.

A biasing member, such as an axial compression spring 306 is positioned between the second spur gear 284 and the hammer 300 to bias the hammer 300 away from the second spur gear 284. In the illustrated embodiment, the spring 306 rotates with the hammer 100 and the bearing 290*c* permits the second spur gear 284 to rotate with respect to the spring 106. Other configurations are possible, and the illustrated configuration is given by way of example only.

The illustrated square drive 288 is formed as a single unitary, monolithic piece with first and second jaws 308*a*, 308*b* to create an anvil 310. The anvil 310 is supported for rotation within the work attachment 214 by the bushing 290*a*. The jaws 304*a*, 304*b* impact respective jaws 308*a*, 308*b* to functionally drive the square drive 288 in response to rotation of the second spur gear 284. The impact cycle is repeated twice every rotation and is similar to the impact cycled illustrated in FIGS. 5A-5J. During the impact cycle, the jaws 304*a*, 304*b* impact the jaws 308*a*, 308*b*. The spring 306 permits the hammer 300 to rebound after impact and balls 298*a*, 298*b* guide the hammer 300 to ride up around the cam shaft 294, such that jaws 304*a*, 304*b* are spaced axially from jaws 308*a*, 308*b*. The jaws 304*a*, 304*b* are permitted to rotate past the jaws 308*a*, 308*b* after the rebound.

A head height dimension 314 of the work attachment 214 is illustrated in FIG. 7. The head height dimension 314 is the axial distance from the top of the angle housing 246 to the bottom of the angle housing 246. The head height dimension 314 is reduced so that the work attachment 214 can fit into small spaces. The motor housing 218 defines a motor housing height dimension 318, as shown in FIG. 7. The head height dimension 314 is smaller than or substantially equal to the motor housing height dimension 318. Such a configuration permits insertion of the tool and the work attachment 214 into smaller spaces than has previously been achievable without compromising torque.

The invention claimed is:

1. An angle impact tool comprising:

a handle housing having an outer handle housing height dimension defined by at least one outer surface of the handle housing;

a motor positioned in the handle housing, the motor having a motor shaft configured to rotate about a first axis;

a work attachment coupled to the handle housing, the work attachment having a first wall and a second wall positioned opposite the first wall, the first wall and the second wall cooperating to define a cavity in the work attachment, wherein the work attachment includes a head height dimension defined between a first outer surface of the first wall and a second outer surface of the second wall; and an impact mechanism positioned in the cavity of the work attachment, the impact mechanism having a hammer and an anvil and being configured to rotate about a second axis that is non-parallel to the first axis;

wherein the head height dimension of the work attachment is smaller than the outer handle housing height dimension of the handle housing.

2. The angle impact tool of claim 1, wherein: (i) the impact mechanism further includes an impact mechanism height dimension defining a height of the impact mechanism, and (ii) the impact mechanism is positioned in the cavity such that the head height dimension encompasses the impact mechanism height dimension.

3. The angle impact tool of claim 1, wherein the second axis is perpendicular to the first axis.

4. The angle impact tool of claim 1, wherein the head height dimension extends parallel to the second axis and the handle housing height dimension extends parallel to the second axis.

5. The angle impact tool of claim 1, wherein the head height dimension extends orthogonal to the first axis and the handle housing height dimension extends orthogonal to the first axis.

6. The angle impact tool of claim 1, wherein the head height dimension extends parallel to the handle housing height dimension.

7. The angle impact tool of claim 1, further comprising an output shaft supported by the work attachment and extending through a passageway formed in the first wall, the output shaft being configured to rotate about the second axis.

8. The angle impact tool of claim 7, wherein:

(i) the hammer of the impact mechanism is rotatably coupled to the motor shaft and the anvil is coupled to the output shaft, and (ii) in response to rotation of the motor shaft about the first axis, the hammer rotates about the second axis and periodically strikes the anvil such that the anvil and the output shaft rotate about the second axis.

9. The angle impact tool of claim 1, further comprising a gear assembly positioned between the impact mechanism and the motor, the gear assembly being rotationally coupled to the hammer and rotationally coupled to the motor shaft, the gear assembly configured to transmit the rotation of the motor shaft about the first axis to the hammer of the impact mechanism.

10. The angle impact tool of claim 1, wherein the outer surface of the handle housing is shaped to be grasped by a user.

11. An angle impact tool comprising:

a motor including a motor shaft configured to rotate about a first axis, and a motor housing having at least one outer surface, and an outer motor housing height dimension defined by the at least one outer surface;

a work attachment coupled to the motor housing, the work attachment having a head height dimension extending between a first outer surface of the work attachment and a second outer surface of the work attachment positioned opposite the first outer surface; and an impact mechanism positioned in the work attachment between the first outer surface and the second outer surface, the impact mechanism having a hammer and an anvil and being configured to rotate about a second axis that is non-parallel to the first axis;

wherein the head height dimension of the work attachment is smaller than the outer motor housing height dimension of the motor housing.

12. The angle impact tool of claim 11, wherein the impact mechanism is positioned in the work attachment such that the head height dimension is larger than and encompasses an impact mechanism height dimension defined by the impact mechanism.

13. The angle impact tool of claim 11, wherein: (i) the outer surface of the motor housing is cylindrical in shape and (ii) the outer motor housing height dimension is defined between two diametrically opposed points on the cylindrical outer surface.

14. The angle impact tool of claim 11, further comprising an output shaft supported by the work attachment and extending through a passageway formed in the first outer surface, the output shaft being configured to rotate about the second axis.

* * * * *